US011807421B2

(12) United States Patent
Ouderkirk et al.

(10) Patent No.: US 11,807,421 B2
(45) Date of Patent: Nov. 7, 2023

(54) FILL NOZZLE PASS THROUGH FLAME MITIGATION DEVICE FOR PORTABLE FUEL CONTAINER

(71) Applicant: SURECAN, INCORPORATED, North Ogden, UT (US)

(72) Inventors: Brad Ouderkirk, North Ogden, UT (US); E. Jex Heaton, North Ogden, UT (US); Steven F. Brown, North Ogden, UT (US)

(73) Assignee: SURECAN, INCORPORATED, North Ogden, UT (US)

( * ) Notice: Subject to any disclaimer, the term of this patent is extended or adjusted under 35 U.S.C. 154(b) by 592 days.

(21) Appl. No.: 16/538,473

(22) Filed: Aug. 12, 2019

(65) Prior Publication Data

US 2021/0047080 A1 Feb. 18, 2021

(51) Int. Cl.

| | |
|---|---|
| ***B65D 25/38*** | (2006.01) |
| ***A62C 3/06*** | (2006.01) |
| *B65D 25/48* | (2006.01) |

(52) U.S. Cl.

CPC ..... *B65D 25/385* (2013.01); *A62C 3/065* (2013.01); *B65D 25/48* (2013.01); *B65D 2251/205* (2013.01)

(58) Field of Classification Search

CPC ..... B65D 25/385; B65D 25/48; B65D 2251/205; B65D 25/40; B65D 25/50; B65D 90/22; B65D 51/00; A62C 3/065; A62C 4/00; B67D 7/005

USPC ..... 220/88.1, 229, 719, 370

See application file for complete search history.

(56) References Cited

U.S. PATENT DOCUMENTS

| | | | | |
|---|---|---|---|---|
| 2,858,943 | A | 11/1958 | Richmond | |
| 4,884,717 | A * | 12/1989 | Bussard | B65D 47/06 426/115 |
| 4,892,209 | A | 1/1990 | Dorfman et al. | |
| 7,162,766 | B1 * | 1/2007 | Yakopcic | A63B 57/60 15/160 |
| 8,251,109 | B2 | 8/2012 | Gebert et al. | |
| 8,448,802 | B2 | 5/2013 | Hisadomi et al. | |
| 8,453,864 | B2 * | 6/2013 | Krueger | B65D 51/00 220/370 |

(Continued)

FOREIGN PATENT DOCUMENTS

| | | | |
|---|---|---|---|
| CN | 205964761 | U | 2/2017 |
| DE | 19533306 | C1 | 12/1996 |
| DE | 202012105050 | U1 | 3/2014 |

OTHER PUBLICATIONS

"Flameshield Safety System", http://www.midwestcan.com/flameshield-safety-system.html, Date of publication: Jan. 1900.

(Continued)

*Primary Examiner* — James N Smalley
*Assistant Examiner* — Madison L Poos
(74) *Attorney, Agent, or Firm* — DORSEY & WHITNEY LLP

(57) ABSTRACT

A flame mitigation device (FMD) contained within the neck of a container and configured to allow the fuel nozzle to pass through the FMD. The FMD forming a barrier in the neck of the fill port and capable of constricting the fuel nozzle upon passing through the FMD to inhibit external debris from entering the interior of the portable container and to inhibit fuel from flowing back out of the fill port.

19 Claims, 14 Drawing Sheets

(56) References Cited

U.S. PATENT DOCUMENTS

| | | | | |
|---|---|---|---|---|
| 8,517,198 | B2 | 8/2013 | Muto et al. | |
| 8,616,403 | B2 | 12/2013 | Hisadomi et al. | |
| 8,910,835 | B2 | 12/2014 | Ouderkirk | |
| 9,096,355 | B2 | 8/2015 | Jensen | |
| 9,174,075 | B2 | 11/2015 | Cray | |
| 9,415,994 | B2 | 8/2016 | Ouderkirk | |
| 9,707,422 | B2 | 7/2017 | Elias et al. | |
| 10,029,132 | B2 | 7/2018 | Cray | |
| 2008/0271814 | A1 | 11/2008 | Wilton et al. | |
| 2010/0288762 | A1 | 11/2010 | Kokubu et al. | |
| 2011/0259885 | A1 | 10/2011 | Muto et al. | |
| 2013/0320009 | A1* | 12/2013 | Cray | A62C 3/065 220/88.1 |
| 2016/0045774 | A1 | 2/2016 | Cray | |
| 2017/0266474 | A1 | 9/2017 | Elias et al. | |
| 2018/0221693 | A1* | 8/2018 | Cray | A62C 3/065 |

OTHER PUBLICATIONS

"No Spill Introduces Gas Can with Newly Developed Technology", http://www.c2rtech.net/, Date of publication: Feb. 2017.

* cited by examiner

FILL NOZZLE PASS THROUGH FLAME MITIGATION DEVICE FOR PORTABLE FUEL CONTAINER

TECHNICAL FIELD

The present disclosure generally relates to flame mitigation devices, and more particularly to flame mitigation devices used in portable fuel containers.

BACKGROUND

Portable containers for transporting liquid fuel, such as gasoline, provide a convenient way of replenishing expended fuels in devices that require periodic fueling (e.g., lawnmowers, vehicles, generators, ATVs, etc.). Portable liquid fuel containers (e.g., gas cans) are commonly made of plastic and include a removable spout that connects to a fill opening of the container. The gas can is usually tipped to pour the fuel out of the spout. An air inlet is sometimes provided along the top side of the gas can to equalize pressure within the gas can for improved outflow of fuel through the nozzle. Other container configurations are possible, for instance, the container could include a fill port and a separate spout for dispensing fuel, as discussed in U.S. Pat. Nos. 8,910,835 and 9,415,994, which are hereby incorporated by reference in their entirety.

When properly used many traditional portable fuel containers are safe and effective for their intended purpose. Unfortunately, by disregarding sufficient warnings, instructions, and common sense, a negligent user may improperly use the fuel container. For instance, a negligent user may recklessly pour fuel from a portable container onto a smoldering campfire or open flame creating a risk of explosion. Additionally, an exposed port in the fuel container creates a risk of sparks or debris entering the container.

SUMMARY

One aspect of the present disclosure relates to a fuel storage device. The fuel storage device can comprise a portable container having a top portion, a bottom portion, and sidewalls extending between the top portion and the bottom portion. The portable container can define an interior that is configured to hold fuel. A fill port can be configured to receive a fuel nozzle, the fill port can be defined by a neck that extends from the top portion of the portable container. A flame mitigation device (FMD) can be contained within the neck and configured to allow the fuel nozzle to pass through the FMD. The FMD can form a barrier in the neck of the fill port and can constrict the fuel nozzle upon passing through the FMD to inhibit external debris from entering the interior of the portable container and to inhibit fuel from flowing back out of the fill port.

The FMD can be secured within the neck between a bulge and a shelf molded into an interior of the neck. The FMD can comprise a rim and a plurality of bristles extending inwardly from the rim. The FMD can comprise a plurality of sheets layered over one another, each sheet comprising converging slits that are offset from neighboring sheets.

The FMD can comprise an annular rim comprising a barrier extending inwardly from the annular rim, the barrier defining a rectangular aperture, and a plurality of bristles extending inwardly from one or more sides of the barrier, the plurality of bristles configured to cover the rectangular aperture.

The FMD can comprise an annular rim and can be substantially disk shaped. The fuel storage device can further comprise a spout configured to dispense fuel from the portable container. The spout can be located near the bottom portion of the portable container such that a fuel-to-air ratio at the spout is too fuel rich for ignition. The FMD can be configured to allow the fill port to serve as an air intake while the fuel nozzle is inserted in the fill port.

Another aspect of the present disclosure relates to a fuel container comprising a container having a top portion, a bottom portion, and sidewalls. The container can define a hollow interior for storing fuel. A spout can be in fluid communication with the hollow interior of the container. The spout can be rotatable between a retracted upright position and an extended downward position relative to the container. The spout can be located proximate the bottom portion of the container. The fuel container can comprise a fill port configured to receive a fuel nozzle. The fill port can be defined by a neck disposed proximate the top portion of the container. The fuel container can further comprise a flame mitigation device (FMD) contained within the neck and configured to allow the fuel nozzle to pass through the FMD. The FMD forms a barrier in the neck of the fill port and can constrict the nozzle upon passing through the FMD to inhibit fuel from flowing back out of the fill port and to inhibit external debris from entering the interior of the container.

Another aspect of the present disclosure relates to a fuel container comprising a fill port configured to receive a fuel nozzle, the fill port can be defined by a neck; and a flame mitigation device (FMD) contained within the neck and configured to allow the fuel nozzle to pass through the FMD. The FMD can form a barrier in the neck of the fill port and can constrict the nozzle upon passing through the FMD to inhibit fuel from flowing back out of the fill port.

Another aspect of the present disclosure relates to a flame mitigation device (FMD) comprising an annular rim and a plurality of bristles extending inwardly from the annular rim, the plurality of bristles configured to converge to a central axis of the annular rim to inhibit fuel from flowing through the annular rim.

The annular rim of the FMD can be helical. The FMD can be configured to be removably inserted into a fill port of a fuel container. The fuel container can comprise a spout to dispense fuel, the spout can be separate from the fill port. The FMD can be configured to allow a nozzle to pass through the annular rim such that the plurality of bristles constrict the nozzle upon passing through the annular rim. The FMD can be configured to operate with a fuel tank in a vehicle.

Another aspect of the present disclosure relates to a flame mitigation device (FMD) comprising a plurality of sheets layered over one another. Each sheet can comprise converging slits that are offset from neighboring sheets to inhibit fuel from flowing through the flame mitigation device. The FMD can be disposed within a fill port of a fuel container such that the plurality of sheets form a barrier in the fill port. The plurality of sheets can be configured to deform to allow passage of a nozzle. The plurality of sheet can also be configured to rebound after removal of the nozzle. The FMD can prevent a continuous stream of fuel from being dispensed out of the fill port.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
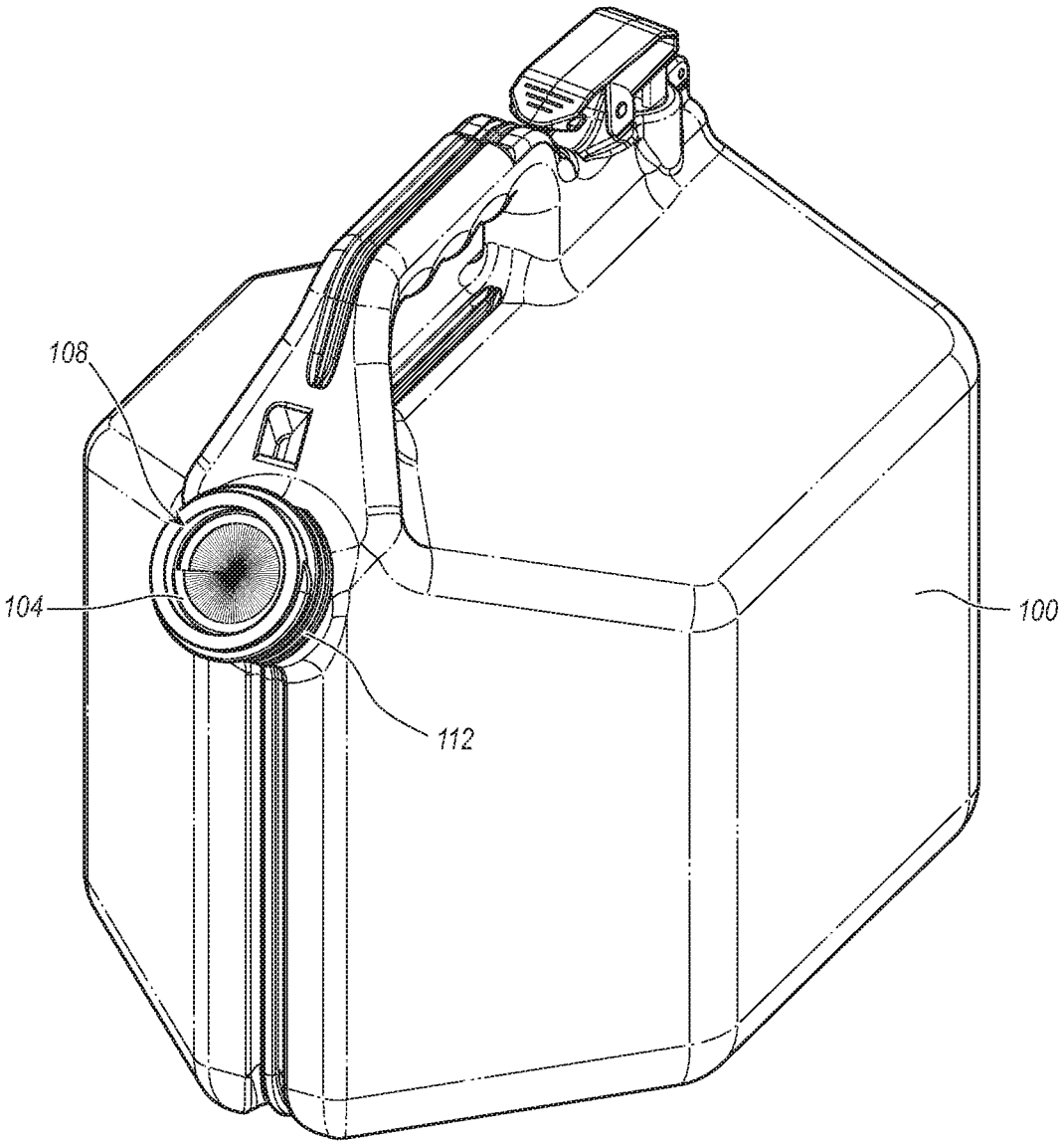
FIG. 1A is a perspective view of a container including a bristle-type FMD.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure relates to a flame mitigation device (FMD) for use in fuel containers. The fuel containers disclosed herein are typically handheld, portable containers often referred to as gas cans. Although the FMD's disclosed herein are generally configured to be used with fuel containers that may be moved and carried by a single user, the embodiments disclosed herein may be applicable to other types of containers, such as containers that are much larger and intended to remain stationary, or containers intended to hold other types of fluids besides liquid fuel.

The example fuel containers disclosed herein may also include an outlet spout. The outlet spout may be coupled in fluid communication with the interior of the container. The spout may be movable between a dispense position and a stowed position. The container may also include a handle to improve ease in handling or carrying the fuel container device. The container may also include a fill port opening and associated cap used to fill the fuel container.

The FMD disclosed herein can be positioned within a neck of the fill port and form a barrier that inhibits unwanted debris or fuel from passing though the fill port. The FMD can include bristles configured to allow a nozzle to pass through the annular rim such that the plurality of bristles constrict the nozzle upon passing through the annular rim. Alternatively, the FMD can comprise a plurality of sheets layered over one another. Each sheet can comprise converging slits that are offset from neighboring sheets to inhibit fuel from flowing through the flame mitigation device. The plurality of sheets can be configured to deform to allow passage of a nozzle. The plurality of sheet can also be configured to rebound after removal of the nozzle. The FMD can prevent a continuous stream of fuel from being dispensed out of the fill port. The disclosed embodiments of the FMD can inhibit external debris from entering the interior of the portable container and to inhibit fuel from flowing back out of the fill port.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

FIGS. 1A-3B illustrate a container 100 including a bristle-type FMD 104. The container 100 can include a top portion, a bottom portion, and sidewalls extending between the top portion and bottom portion to form a hollow interior suitable for storing a volume of fluid. The container 100 can include a fill port 108 that is used to receive fuel dispensed into the container 100. The fill port 108 can be defined by a neck 112 that protrudes from the container 100. The fill port 108 can be located in the top portion of the container 100. In some embodiments, an exterior of the neck 112 includes attachment features (e.g., threads) to attach a lid or cap (not shown) over the fill port 108.

Figure 3A:
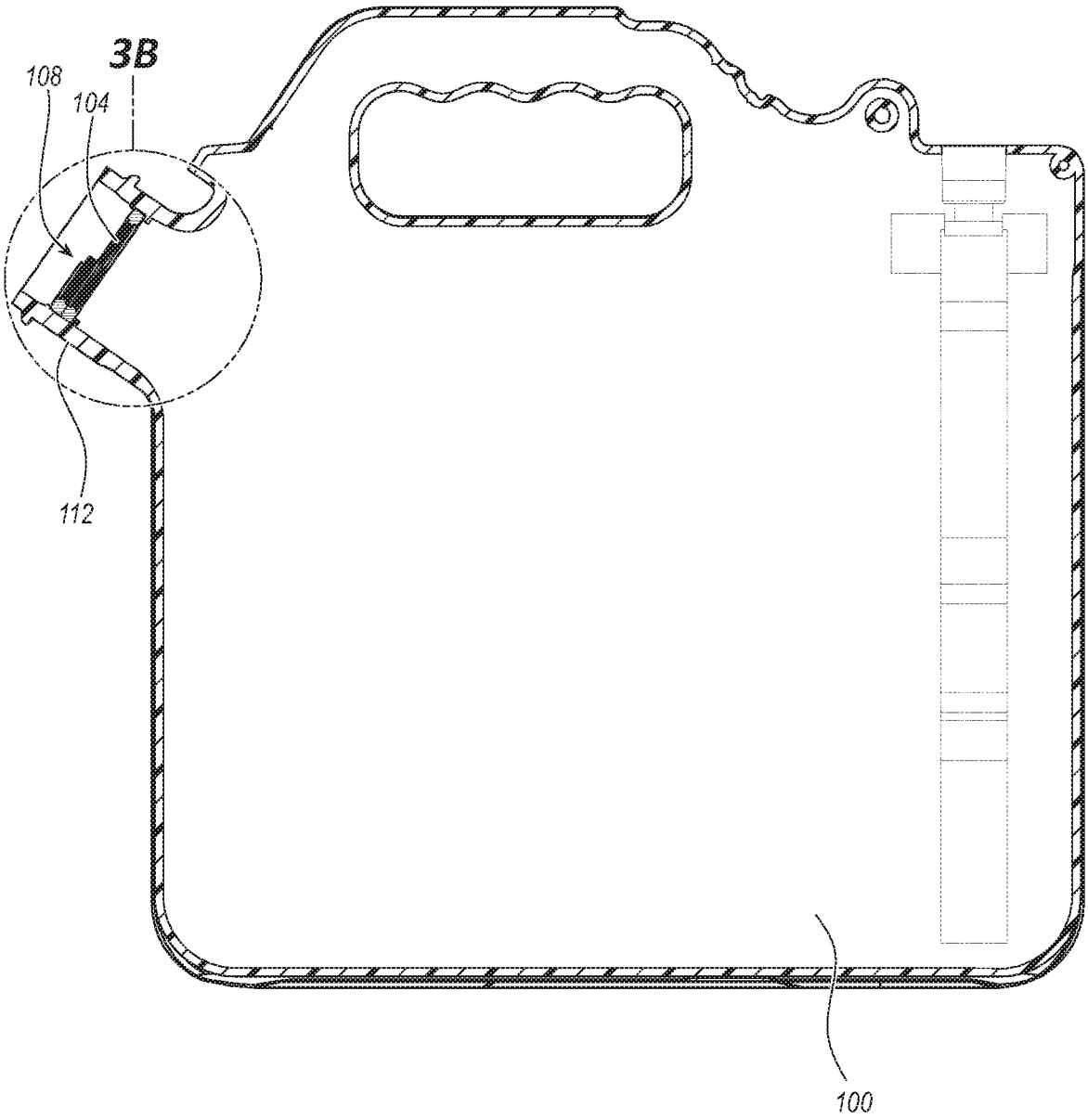
FIG. 3A is a cross-sectional view of the container of FIG. 1A
Figure 3B:
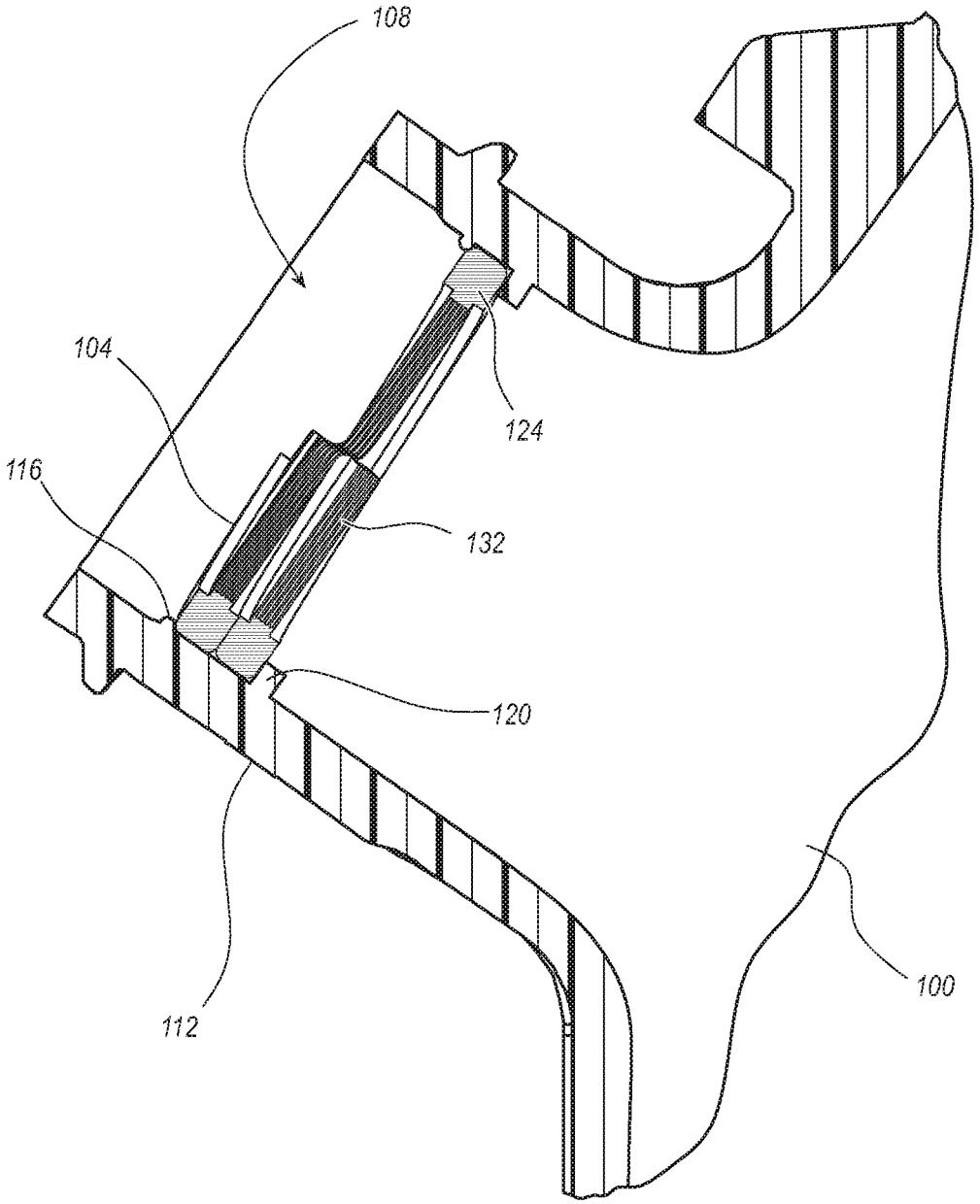
FIG. 3B is a cross-sectional side view of the bristle-type FMD within a neck of the container.

FIGS. 3A and 3B illustrate cross-sectional side views of the container 100 and the FMD 104 disposed within the neck 112 of the container 100. The FMD 104 can be contained entirely within the neck 112, that is, no portion of the FMD 104 extends past the neck into the interior of the container 100. An interior of the neck 112 can include engagement features configured to secure the FMD 104 within the neck 112. In one embodiment, the engagement features in the neck 112 comprise a bulge 116 and a shelf 120 molded into the interior walls of the neck 112. The bulge 116 and shelf 120 can extend circumferentially within the interior of the neck 112.

In some embodiments, the FMD 104 can be inserted into the neck 112. Upon coming into contact, the bulge 116 and/or the FMD 104 can be configured to bend or flex such that the FMD 104 snaps into a secured position between the bulge 116 and the shelf 120. As shown in FIG. 3B, the shelf 120 can contact a rim 124 of the FMD 104 to prevent the FMD 104 from entering the container 100 beyond the neck 112. By applying a sufficient force, the FMD 104 can be removed from the neck 112 over the bulge 116. The amount of force required to remove the FMD 104 from the neck 112 can be predetermined to meet safety standards (e.g., 15 lbs of pull). Removal of the FMD 104 can be desired in order to clean or replace the FMD 104. It will be appreciated that other suitable forms of securing the FMD within the neck are possible. The FMD 104 can be positioned at any reasonable location along the neck 112. The FMD 104 can be positioned outside of the neck 112 on an exterior end of the fill port 108. In some embodiments, the FMD 104 is integrally formed in the neck 112.

Figure 1B:
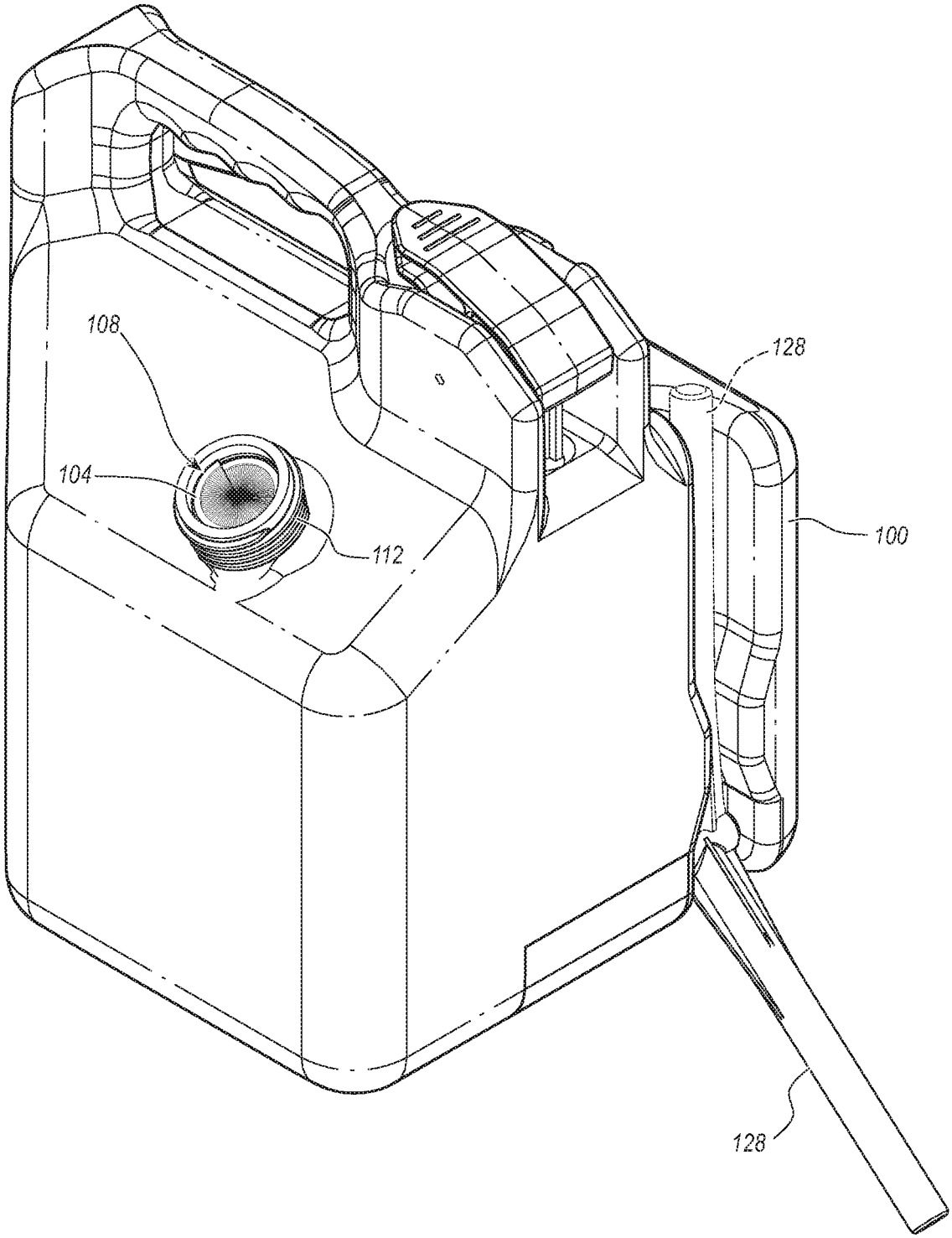
FIG. 1B is a perspective view of a container including a spout and a bristle-type FMD.
Figure 2:
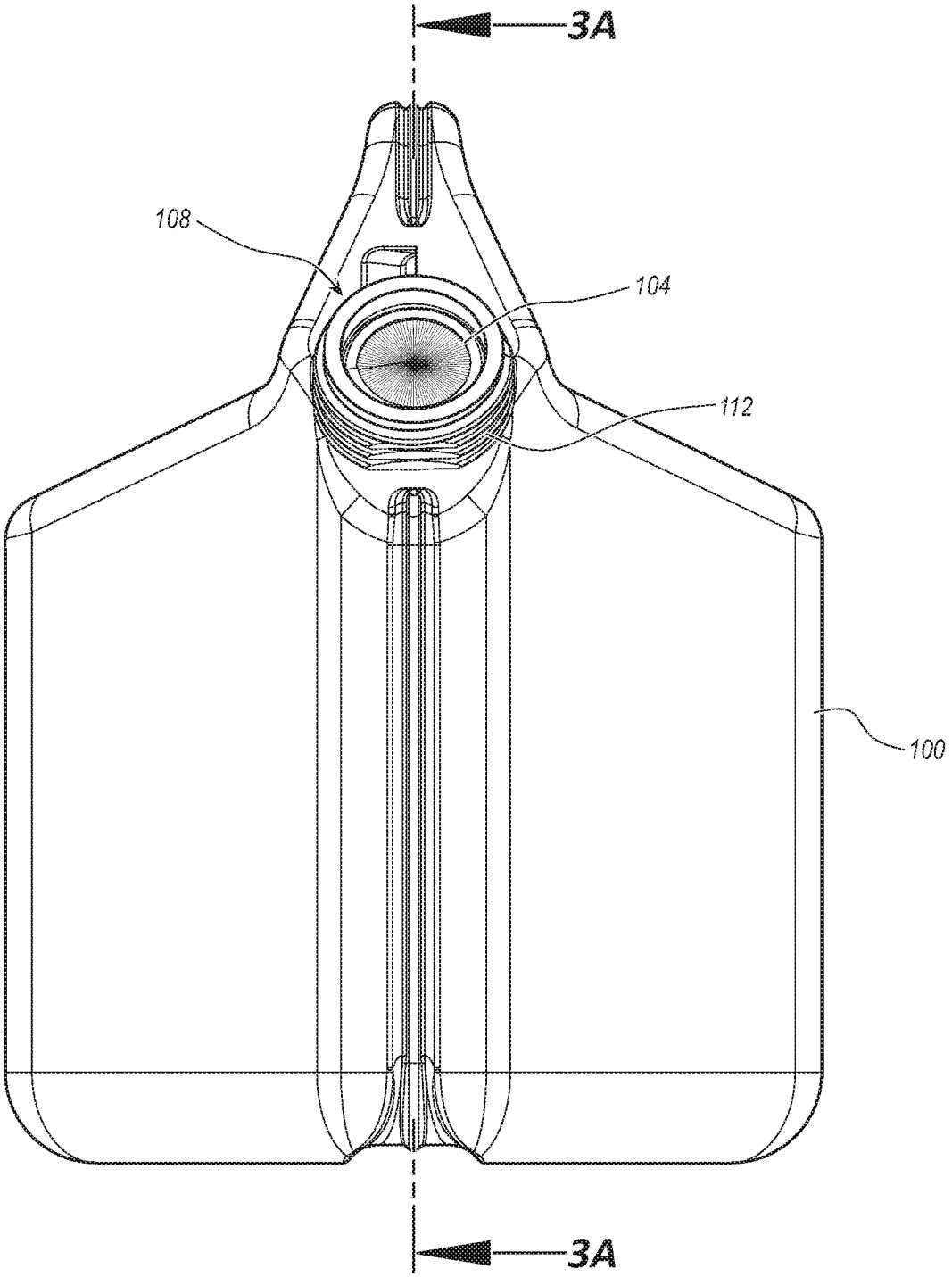
FIG. 2 is a front view of the container of FIG. 1A.

FIG. 1B illustrates an embodiment in which the container 100 includes a spout 128 in addition to the fill port 108. The spout 128 can be configured to dispense fuel from the container 100. Thus, fuel can be poured into the container 100 via the fill port 108 and dispensed out of the container 100 via the spout 128. Because the spout 128 dispensed fuel from the bottom of the container 100, the fuel-to-air ratio at the spout is too fuel rich for ignition. Thus, in the embodiment depicted in FIG. 1B, the fill port 108 is protected against ignition by the FMD 104 and the spout 128 is protected from ignition by the positioning of the spout 128.

Figure 4A:
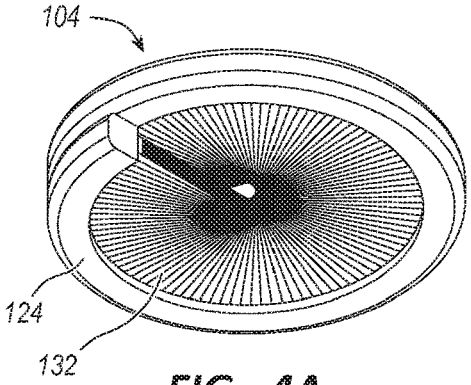
FIG. 4A is a bottom perspective view of a bristle-type FMD.
Figure 4B:
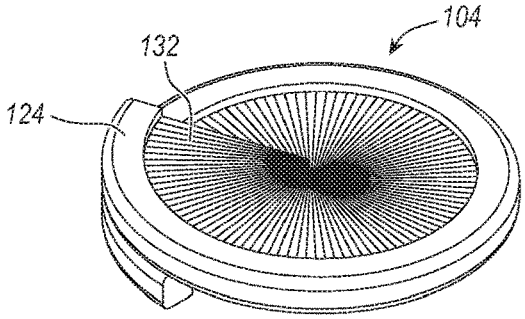
FIG. 4B is a top perspective view of the bristle-type FMD.
Figure 4C:
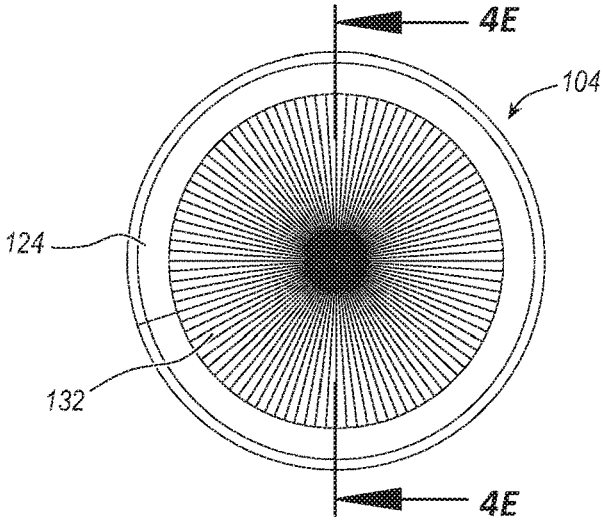
FIG. 4C is a top view of the bristle-type FMD.
Figure 4D:
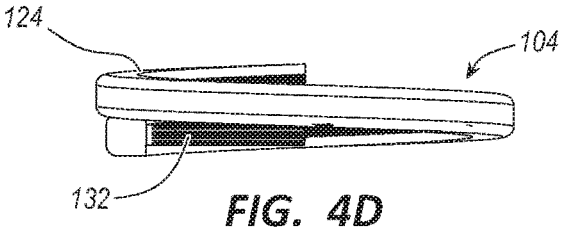
FIG. 4D is a side view of the bristle-type FMD.
Figure 4E:
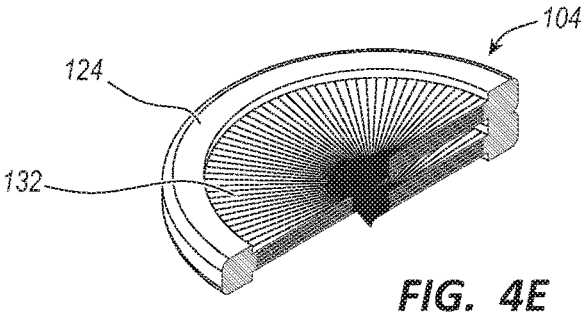
FIG. 4E is a cross-sectional perspective view of a bristle-type FMD.

FIG. 4A-4E illustrate various views of a bristle-type FMD 104 according to one embodiment. The FMD 104 can comprise a rim 124 and a plurality of bristles 132 attached to the rim 124. The rim 124 can be substantially disk shaped and made from high density polyethylene. As shown in FIG. 4C, the rim 124 can be annular, however, other shapes are also possible. The rim 124 can be helical to accommodate for a high density of bristles 132 while still enabling the bristles 132 to converge along a central axis. To increase the density of the bristles 132, the bristles 132 can be stacked in multiple layers.

The bristles 132 can be made from polymers such as nylon or any other suitable substance. The bristles 132 can be flexible such that they constrict around the fuel nozzle as the fuel nozzle passes through the FMD 104. Such constriction around the fuel nozzle can inhibit external debris from entering the interior of the container 100 while refueling. The bristles 132 can also inhibit back splash out of the fill port 108 while filling the container 100. As shown in FIG. 4C, when viewed from above the bristles 132 converge near a center of the rim 124 such that there is little to no aperture through the FMD 104. The bristles 132 converging along the central axis ensure that liquid cannot freely flow in a column past the FMD 104. By preventing a column of fuel from being poured out of the fill port 108, the chances that a flame will travel up the fuel into the container is dramatically decreased. In addition to not allowing a steady column of fuel to be dispensed from the container 100, the mere presence of an FMD in the neck 112 would discourage a user from attempting to pour fuel out of the fill port 108.

Figure 5:
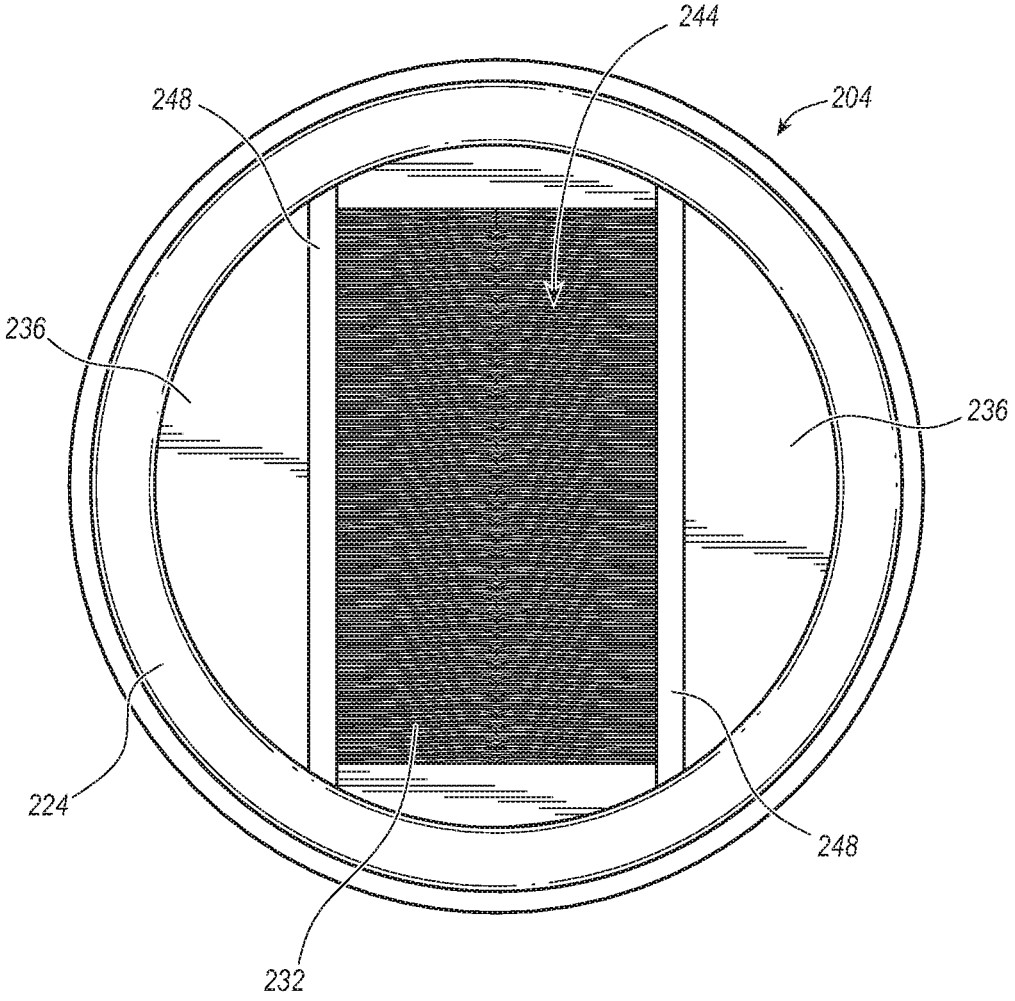
FIG. 5 is a top view of another embodiment of a bristle-type FMD.
Figure 6A:
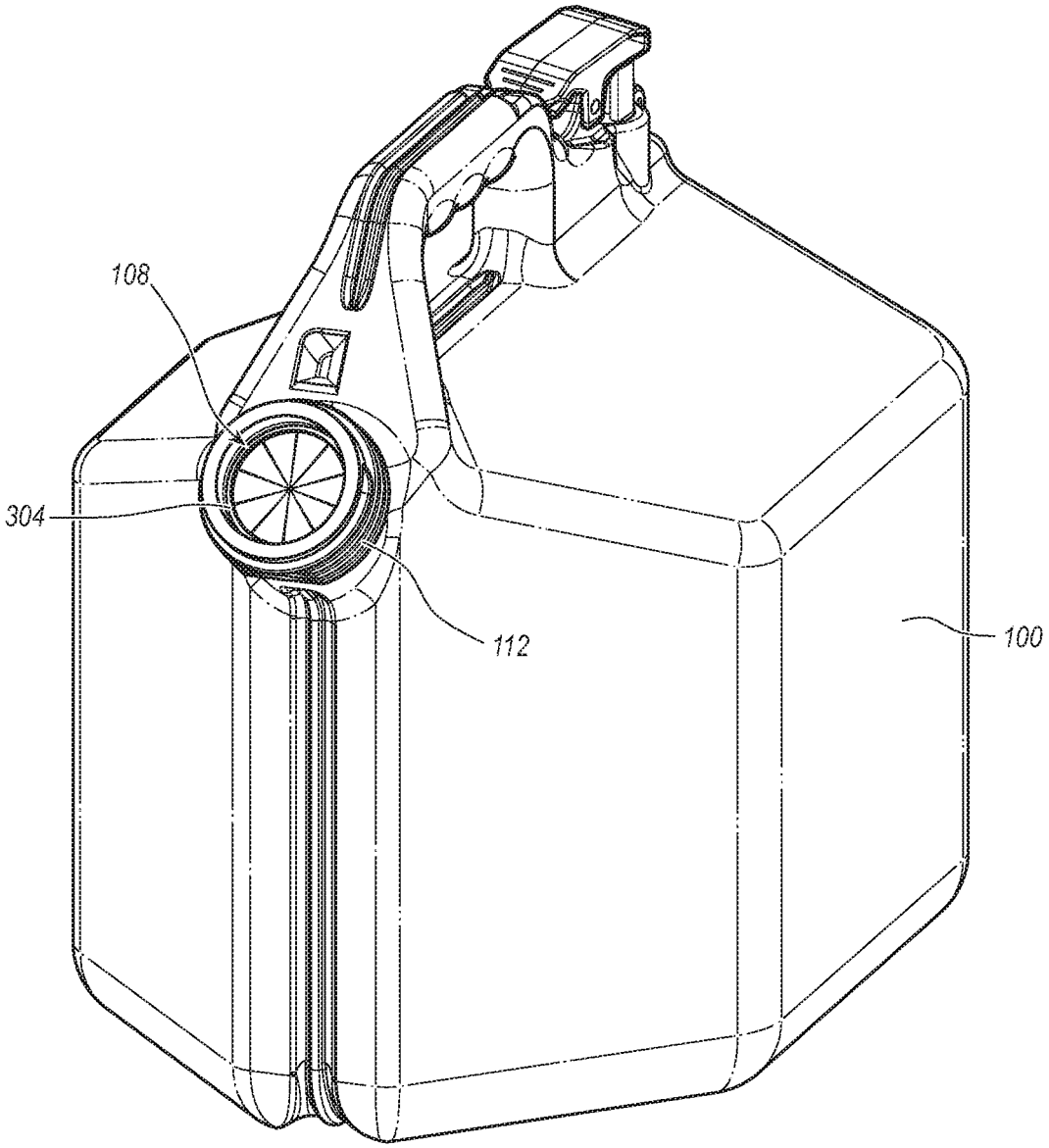
FIG. 6A is a perspective view of a container including a sheet-type FMD.
Figure 6B:
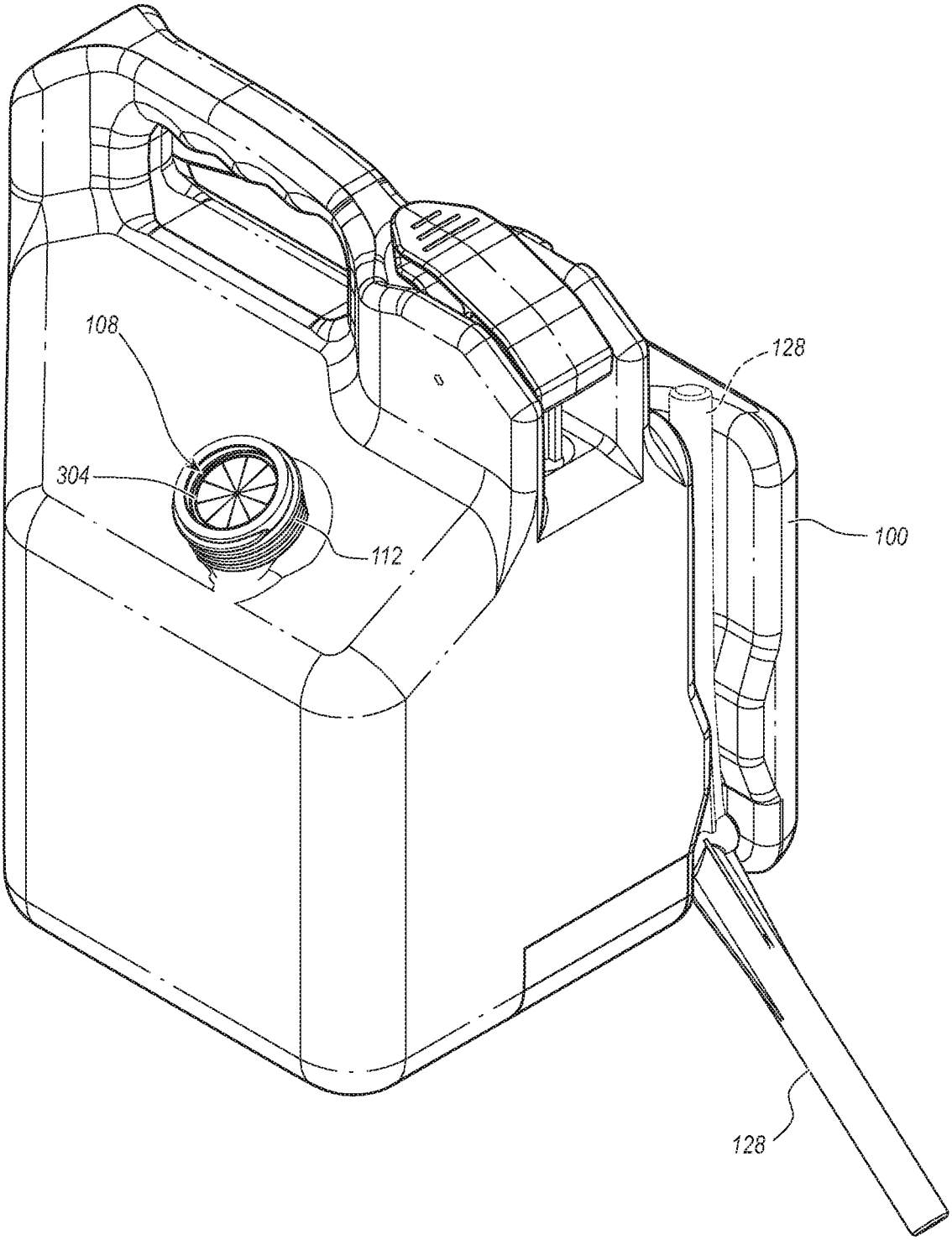
FIG. 6B is a perspective view of a container including a spout and a sheet-type FMD.
Figure 7:
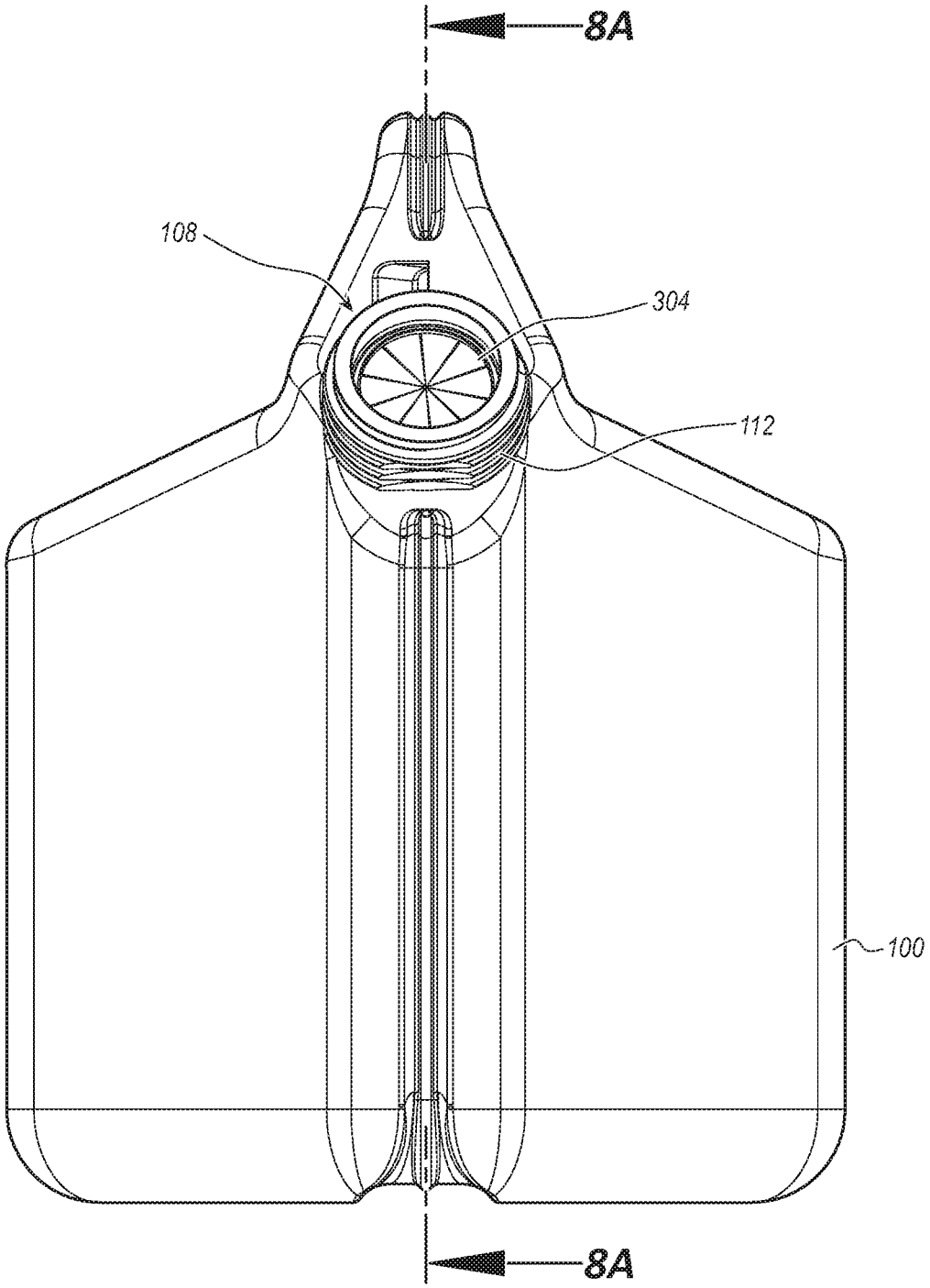
FIG. 7 is a front view of the container of FIG. 6A.

FIG. 5 is a top view of another embodiment of a bristle-type FMD 204. The FMD 204 can comprise an annular rim 224, bristles 232, sheets 236, and clamping elements 248. Unlike the rim 124 which could be helical to accommodate a high density of bristles 132, the annular rim 224 can form a planar ring. The sheets 236 can be configured to extend inwardly from the annular rim 224 to form a rectangular aperture 244. The sheets 236 can be made from plastic, metal, or any other suitable impermeable substance. One or more sides of the rectangular aperture 244 can include clamping elements 248 that can be over molded into the annular rim 224 and/or the sheets 236. The clamping elements can be made from metal. The bristles 232 can extend from the clamping elements 248 such that the bristles 232 cover the rectangular aperture 244.

For instance, the FMD 204 can include two clamping elements 248 along opposing sides of the rectangular aperture 244. The bristles 232 can extend from each clamping elements 248 and meet along a bisecting line of the rectangular aperture 244. In another embodiment, a single clamping element 248 can be positioned along one of the sides of the rectangular aperture 244. The bristles 232 can then cover the rectangular aperture 244 by extending from the clamping element 248 to an opposing side of the rectangular aperture 244. Similar to the embodiments disclosed above with reference to FIGS. 1A-4E, the bristles 232 of FIG. 5 can constrict around a fuel nozzle to block external debris from entering the container and prevent back splash out of the fill port 108.

Figure 8A:
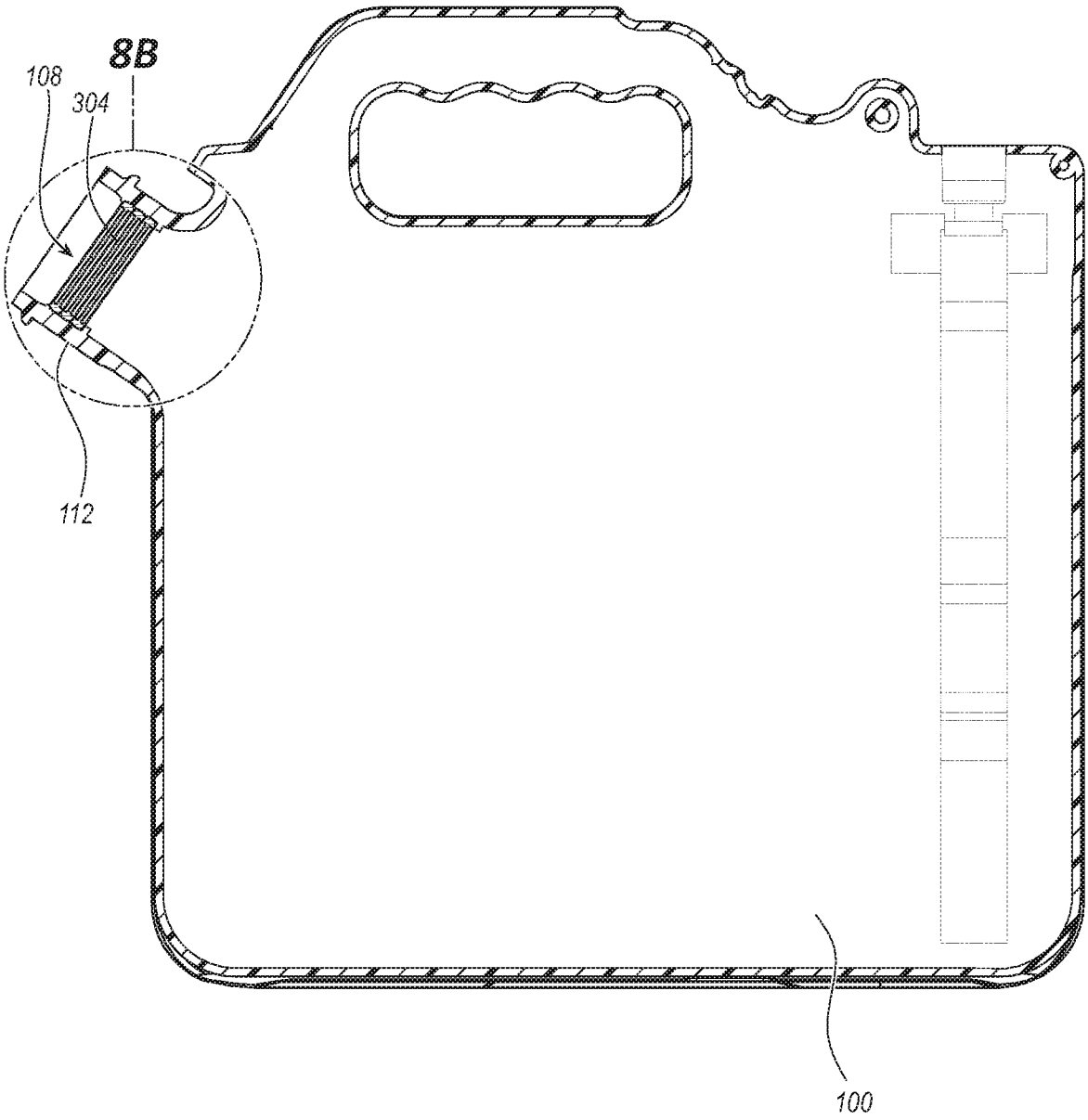
FIG. 8A is a cross-sectional side view of the container of FIG. 6A
Figure 8B:
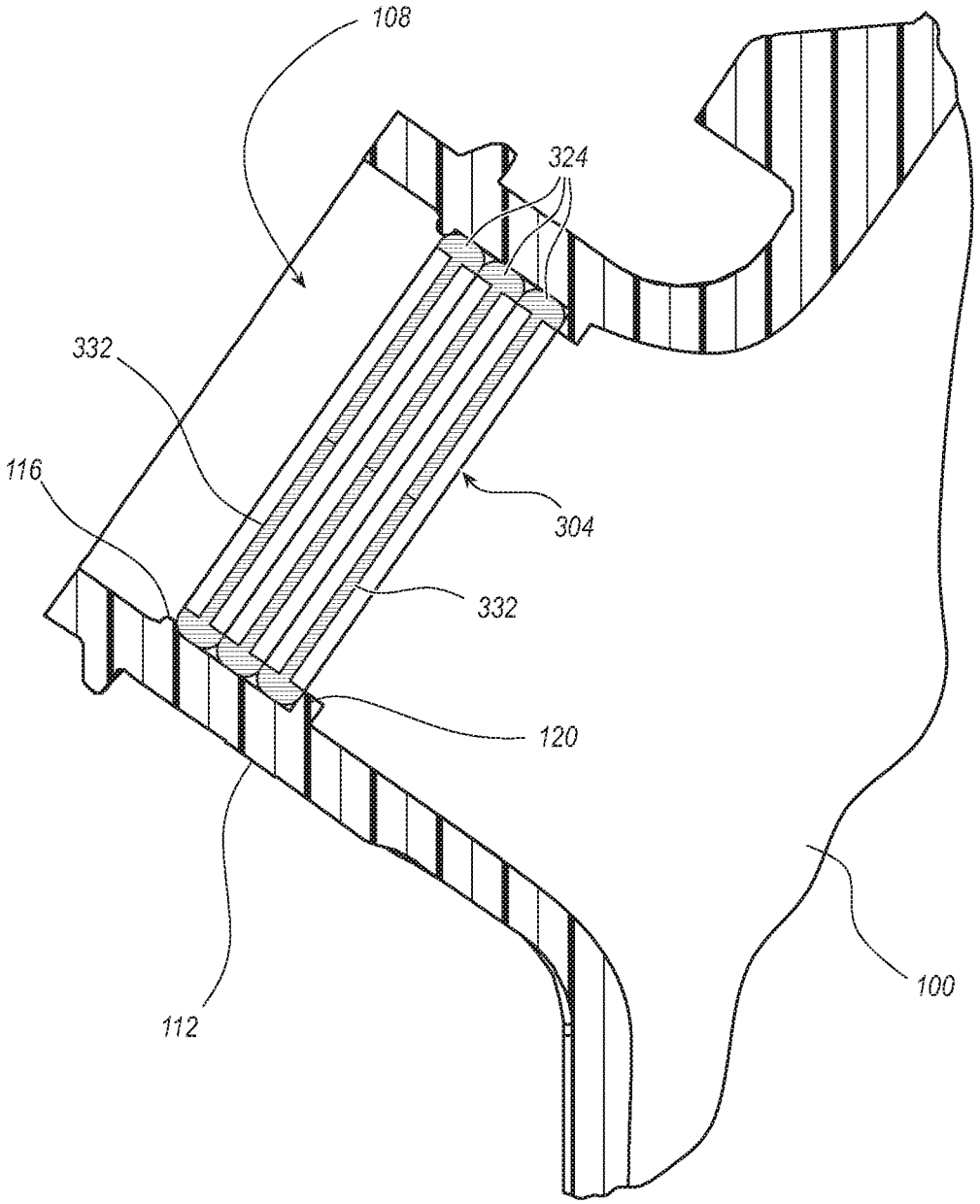
FIG. 8B is a cross-sectional side view of the sheet-type FMD within the neck of the container.
Figure 9A:
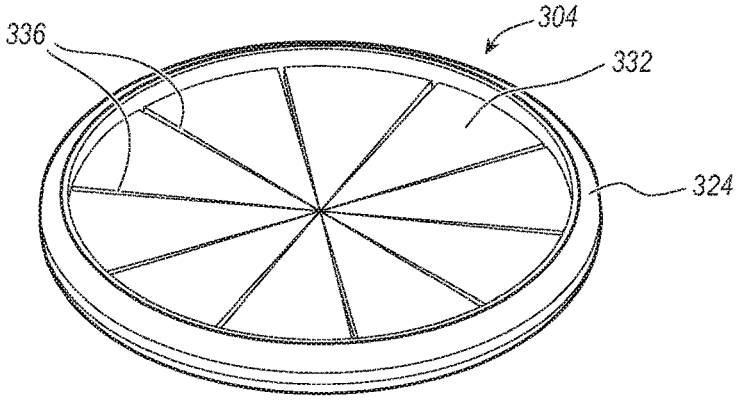
FIG. 9A is a perspective view of a sheet-type FMD.
Figure 9B:
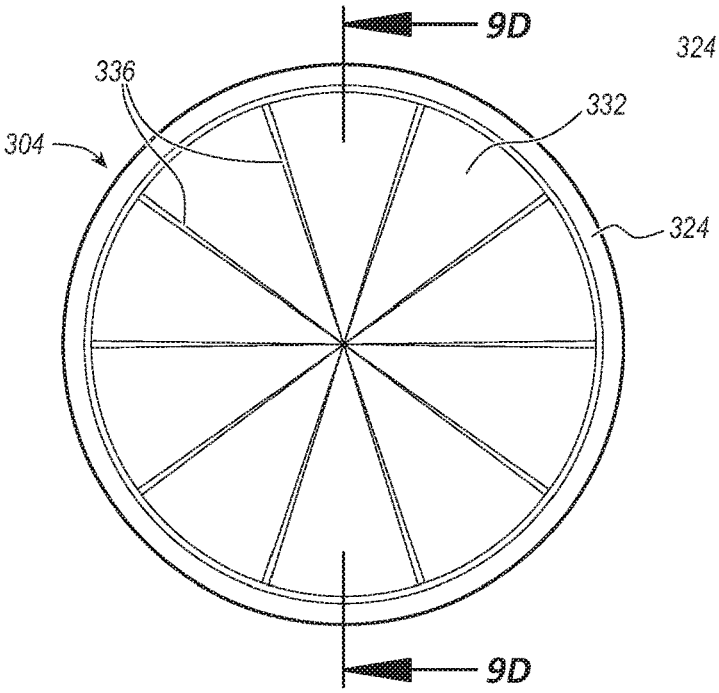
FIG. 9B is a top view of a bristle-type FMD.
Figure 9C:
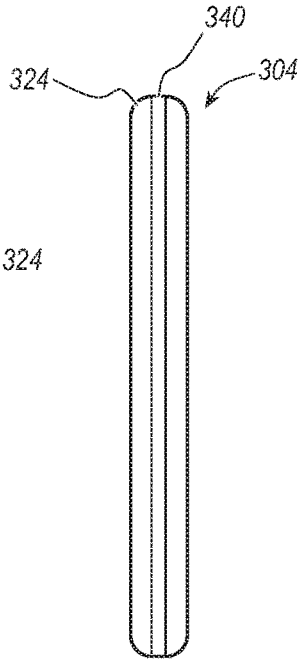
FIG. 9C is a side view of a bristle-type FMD.
Figure 9D:
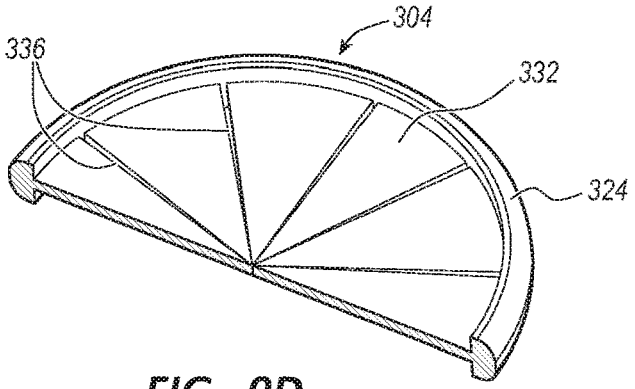
FIG. 9D is a cross-sectional perspective view of a sheet-type FMD.

FIG. 6A-8B illustrate a sheet-type FMD 304 positioned within the container 100. The FMD 304 can be secured in the neck 112 of the container 100 in substantially the same manner as discussed above with reference to the FMD 104. For instance, as illustrated in FIG. 8B, upon being inserted into the neck 112 and coming into contact with the bulge 116, the bulge 116 and/or the FMD 304 can be configured to bend or flex such that the FMD 304 snaps into a secured position between the bulge 116 and the shelf 120. As shown in FIG. 8B, the shelf 120 can contact a rim 324 of the FMD 304 to prevent the FMD 304 from entering the container 100 beyond the neck 112. The FMD 304 can be removed from the neck 112 when applying force. Other engagement mechanisms are also possible to secure the FMD 304 within the neck. For instance, the rim 324 can comprise an external groove 340 configured to receive a protrusion in the neck to secure the FMD 304. In some embodiments, the FMD 104 is integrally formed in the neck 112.

FIG. 9A-9D illustrate various views of the sheet-type FMD 304 according to one embodiment. The FMD 304 can comprise a rim 324, and a sheet 332 that is sliced or divided by slits 336. In some embodiments, the rim 324 is annular, with the FMD 304 being substantially disk shaped, however, it will be appreciated that other shapes are possible. The sheet 332 can be formed from a single unitary piece that is not divided around a perimeter of the sheet. Alternatively the sheet 332 can be composed of several individual sheets that are positioned adjacent one another. The sheet 332 can be made from plastic or any other suitable impermeable material that is flexible and capable of rebounding to a biased position. The sheet 332 can be configured to deform to allow passage of a nozzle (not shown) and to rebound after removal of the nozzle. Thus, the sheet 332 of the FMD 304 can constrict the nozzle once the nozzle passes through the FMD 304. Upon inserting a nozzle into the fill port 108, the sheet 332 separates along the slits 336 to accommodate for the nozzle. This separation can also allow for sufficient air flow such that the FMD 304 and the fill port 108 can serve as an air inlet to equalize pressure within the container 100 for improved inflow/outflow of fuel.

Figure 10A:
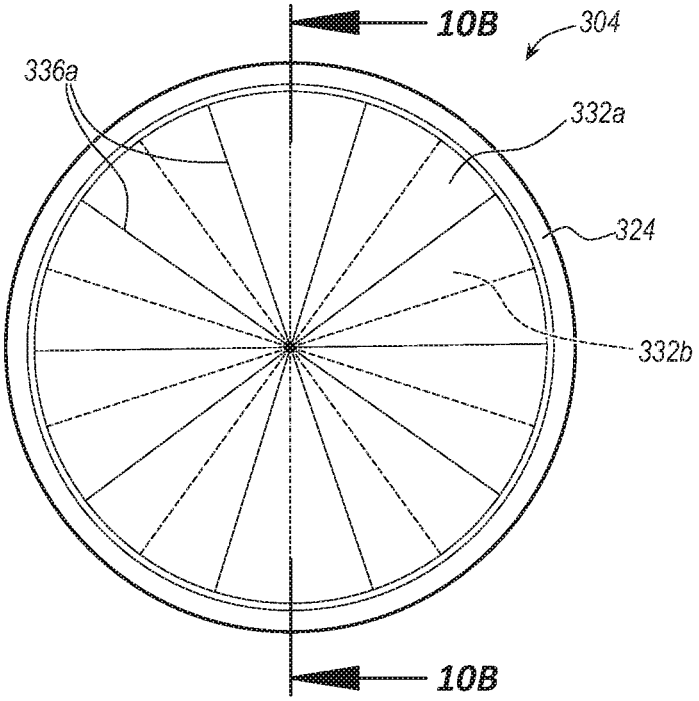
FIG. 10A is a top view of a layered sheet-type FMD.
Figure 10B:
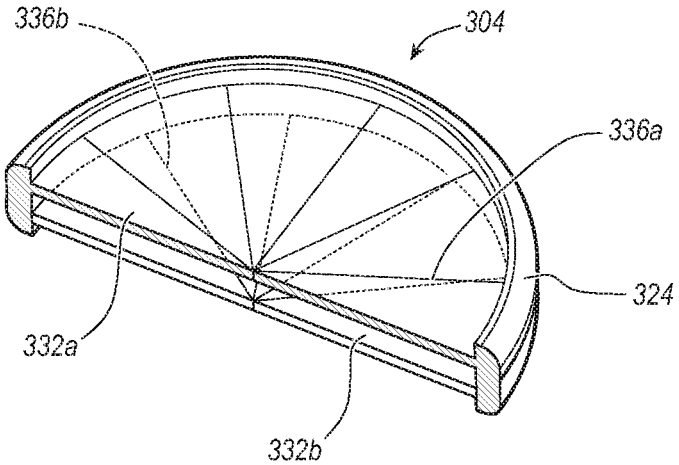
FIG. 10B is a cross-sectional perspective view of a layered sheet-type FMD.

As shown in FIGS. 10A and 10B, the FMD 304 can include a sheet layers 332*a*, 332*b* stacked over one another. Each sheet layer 332*a*, 332*b* can be substantially similar to the sheet 332 discussed above. The sheet layers 332*a*, 332*b* can form a barrier in the fill port 108 that inhibits external debris from entering the container 100. The barrier formed by the sheet layers 332*a*, 332*b* can also prevents a continuous stream of fuel being dispensed out of the fill port 108. In some embodiments, sheet layers are disposed in a single rim. In other embodiments, the FMD 304 can include several rims configured to hold one or more sheet layers. For example, FIG. 8B illustrates multiple rims 324 stacked atop one another, each rim comprising a sheet layer.

As depicted in FIGS. 10A and 10B, sheet layer 332*a* can comprise converging slits 336*a* that are offset from the slits 336*b* of sheet layer 332*b* to inhibit fuel from flowing through the flame mitigation device. The offsets in the slits 336*a*, 336*b* can improve the function of the FMD 304 by better constricting the fuel nozzle and creating a more consistent barrier to prevent dispensing fuel from the container 100 via the fill port 108 and to block external debris from entering the container 100.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A fuel storage device comprising:

a portable container having a top portion, a bottom portion, and sidewalls extending between the top portion and the bottom portion such that the portable container defines an interior that is configured to hold fuel;

a neck extending from the top portion of the portable container, the neck comprising a bulge and a shelf molded into an interior of the neck;

a fill port configured to receive a fuel nozzle, the fill port being defined by the neck; and a flame mitigation device (FMD) comprising a bendable rim and a barrier extending inward of the bendable rim, both the bendable rim and the barrier being removably positioned below the bulge and above the shelf of the neck, wherein the FMD is snap fit between the bulge and the shelf of the neck;

wherein the FMD is configured to allow the fuel nozzle to flexibly deform the barrier when passing through the FMD; and wherein the FMD is configured to flexibly constrict against the fuel nozzle when the fuel nozzle is inserted into the fill port and through the FMD to inhibit external debris from entering the interior of the portable container and to inhibit fuel from flowing back out of the fill port.

2. The fuel storage device of claim 1, wherein an inner diameter of the neck at the bulge is greater than an inner diameter of the neck at the shelf.

3. The fuel storage device of claim 1, wherein the barrier comprises a plurality of bristles extending inwardly from the bendable rim.

4. The fuel storage device of claim 1, wherein the barrier comprises a plurality of sheets layered over one another, each sheet comprising converging slits that are offset from neighboring sheets.

5. The fuel storage device of claim 1, wherein:

the bendable rim comprises an annular rim;

the barrier defines a rectangular aperture; and the barrier comprises a plurality of bristles configured to cover the rectangular aperture.

6. The fuel storage device of claim 1, wherein the rim comprises an annular rim that is substantially disk shaped.

7. The fuel storage device of claim 1 further comprising a spout configured to dispense fuel from the portable container, the spout being located near the bottom portion of the portable container such that a fuel-to-air ratio at the spout is too fuel rich for ignition.

8. The fuel storage device of claim 1, wherein the FMD is configured to allow the fill port to serve as an air intake while the fuel nozzle is inserted in the fill port.

9. A fuel container comprising:

a container having a top portion, a bottom portion, and sidewalls, the container defining a hollow interior for storing fuel;

a spout in fluid communication with the hollow interior of the container, the spout being rotatable between a retracted upright position and an extended downward position relative to the container, the spout being located proximate the bottom portion of the container;

a neck extending from the top portion of the container, the neck comprising a bulge and a shelf molded into an interior of the neck;

a fill port configured to receive a fuel nozzle, the fill port being defined by the neck; and a flame mitigation device (FMD) comprising a bendable rim and a barrier extending inward of the bendable rim, both the bendable rim and the barrier being removably positioned below the bulge and above the shelf of the neck, wherein the FMD is configured to allow the fuel nozzle to flexibly deform the FMD when passing through the FMD; and wherein the FMD flexibly constricts the fuel nozzle upon passing through the FMD to inhibit fuel from flowing back out of the fill port and to inhibit external debris from entering the interior of the container.

10. A fuel container comprising:

a neck extending from a top portion of a fuel container, the neck comprising a bulge and a shelf molded into an interior of the neck;

a fill port configured to receive a fuel nozzle, the fill port being defined by the neck; and a flame mitigation device (FMD) comprising:

a first bendable rim and a first barrier extending inward of the first bendable rim; and a second bendable rim and a second barrier extending inward of the second bendable rim, wherein:

each of the first bendable rim, the second bendable rim, the first barrier, and the second barrier are removably positioned below the bulge and above the shelf of the neck;

the first bendable rim and the second bendable rim are discrete rims positioned in a stacked configuration relative to each other;

the FMD is configured to allow the fuel nozzle to flexibly deform the FMD when passing through the FMD; and the FMD is configured to flexibly constrict the nozzle upon the nozzle passing through the FMD to inhibit fuel from flowing back out of the fill port.

11. A flame mitigation device (FMD) comprising:

a bendable annular rim; and a plurality of bristles extending inwardly from the bendable annular rim, the plurality of bristles configured to converge to a central axis of the bendable annular rim to inhibit fuel from flowing through the bendable annular rim, wherein the bendable annular rim and the plurality of bristles are positionable below a bulge and above a shelf inside of a fuel container neck, and wherein the bendable annular rim is helical.

12. The FMD of claim 11 configured to be removably inserted into a fill port of a fuel container.

13. The FMD of claim 12, wherein the fuel container comprises a spout to dispense fuel, the spout being separate from the fill port.

14. The FMD of claim 11 configured to allow a nozzle to pass through the bendable annular rim such that the plurality of bristles constrict the nozzle upon passing through the bendable annular rim.

15. The FMD of claim 11 configured to operate with a fuel tank in a vehicle.

16. A flame mitigation device (FMD) comprising:

a bendable rim; and a barrier comprising:

a first sheet layer extending inward of the bendable rim, the first sheet layer defining a first set of converging slits; and a second sheet layer extending inward of the bendable rim, the second sheet layer defining a second set of converging slits, wherein:

the first sheet layer is positioned above the second sheet layer;

the first set of converging slits are positionally offset relative to the second set of converging slits to inhibit fuel from flowing through the flame mitigation device; and each of the bendable rim, the first sheet layer, and the second sheet layer are positionable below a bulge and above a shelf inside of a fuel container neck.

17. The FMD of claim 16, wherein the first sheet layer and the second sheet layer are parallel to each other.

18. The FMD of claim 16, wherein the first sheet layer and the second sheet layer are configured to deform to allow passage of a nozzle and to rebound after removal of the nozzle.

19. The FMD of claim 16, wherein:

each segmented portion of the first sheet layer is coplanar with the first sheet layer; and each segmented portion of the second sheet layer is coplanar with the second sheet layer.

* * * * *